United States Patent [19]

Engels et al.

[11] 4,417,695

[45] Nov. 29, 1983

[54] WATER PASTE EXTRUSION DIE

[75] Inventors: Walter Engels, Tryon, N.C.; Charles E. Willbanks, Spartanburg, S.C.

[73] Assignee: Milliken Research Corporation, Spartanburg, S.C.

[21] Appl. No.: 390,213

[22] Filed: Jun. 21, 1982

[51] Int. Cl.[3] ..... B05C 1/08

[52] U.S. Cl. ..... 239/590.3; 118/259; 239/590.5

[58] Field of Search ..... 118/259, 63, 410; 239/590, 590.3, 590.5

[56] References Cited

U.S. PATENT DOCUMENTS 3,917,888 11/1975 Beam et al. ..... 118/63 X

*Primary Examiner*—John P. McIntosh

*Attorney, Agent, or Firm*—Earle R. Marden; H. William Petry

[57] ABSTRACT

An extrusion die to extrude a water paste onto a web material. The die consists of two separate chambers which equalize the pressure of the water paste prior to extruding same through an elongated slot onto a web of material.

9 Claims, 7 Drawing Figures

WATER PASTE EXTRUSION DIE

This invention relates to a fabric having a surface to which a modification is to be made and to which a substrate has to be applied in order to efficiently handle the fabric while the surface is being modified. In its specific form of the invention a tufted loop fabric has a substrate applied thereto to hold the base of the loops in the substrate while the loops are being cut to provide a cut pile fabric.

Therefore, it is an object of the invention to provide a method and apparatus which allows the application of a holding substrate to fabric on which a surface modification is to be made.

Other objects and advantages of the invention will become readily apparent as the specification proceeds to describe the invention with reference to the accompanying drawings, in which.

Figure 1:
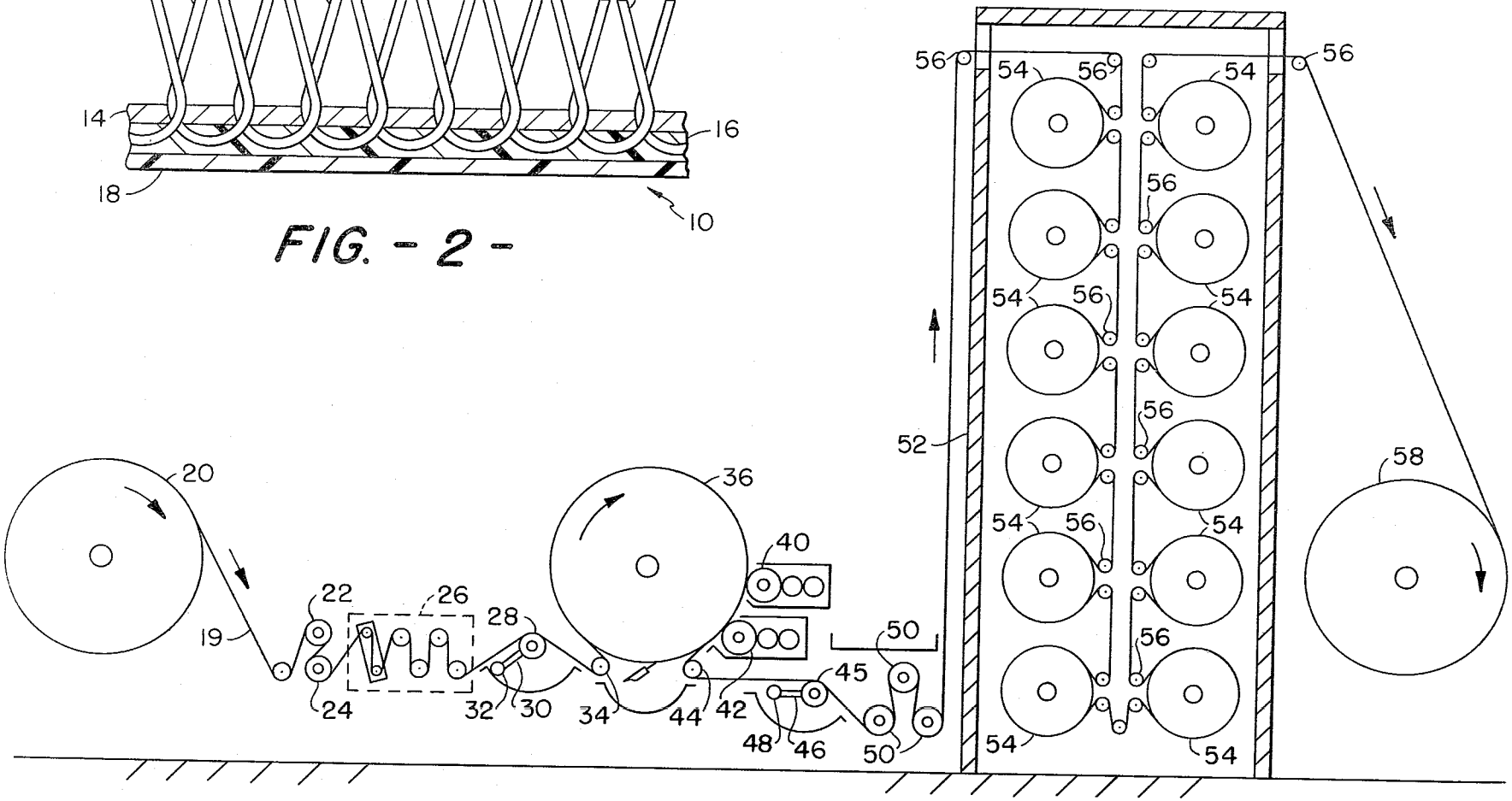
FIG. 1 is an overall schematic representation of the method of applying a substrate to a moving web of material.

Looking now to FIGS. 1 and 2, the basic concept of the invention will be explained. As discussed briefly before, it is the main purpose of the invention to provide a backing for a fabric which allows the fabric to be readily handled and at the same time is relatively inexpensive. In the preferred form of the invention the fabric to be handled is a synthetic, tufted loop fabric which is cut to form a cut, pile fabric. Normally, the fabric has a hard permanent adhesive backing of latex, PVC or other suitable material applied thereto and heat set with the heat setting operation causing some heat setting of the synthetic fibers in the face of this fabric. To eliminate the use of the hard permanent adhesive backing before loop cutting, it is desired to provide a water paste solution to the back of the fabric and then freeze it. If desired, a thinner than normal hard back can be applied after cutting of the fiber loops to provide the cut loop fabric 10 shown in FIG. 2. This basically consists of a plurality of cut fibers 12 tufted into a suitable backing material 14 and held therein the frozen water paste substrate 16. A layer 18 of back coating of latex, PVC or other suitable material may be applied, if desired.

Figure 2:
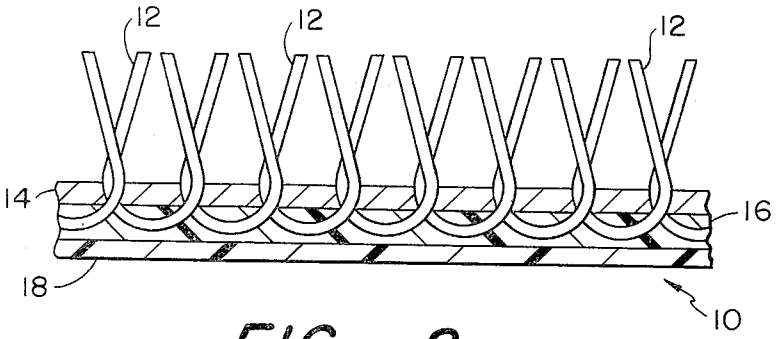
FIG. 2 is a cross-sectional schematic view of a tufted fabric having a substrate applied thereto.
Figure 3:
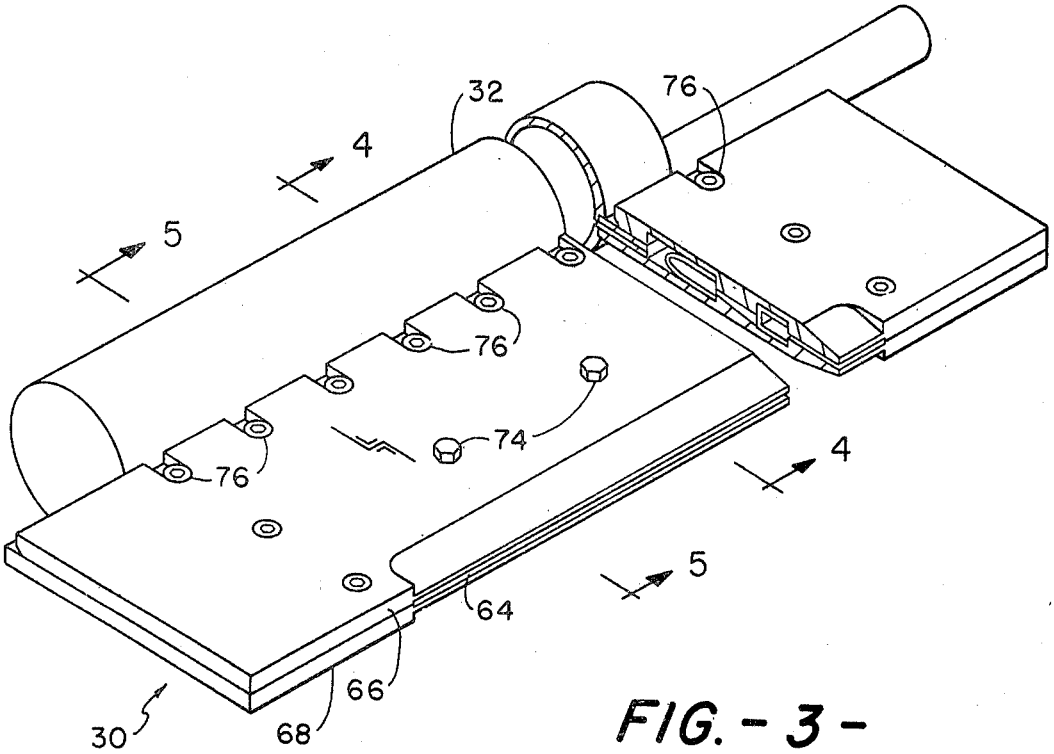
FIG. 3 is a perspective view of the water paste extruder used in the process of FIG. 1.
Figure 4:
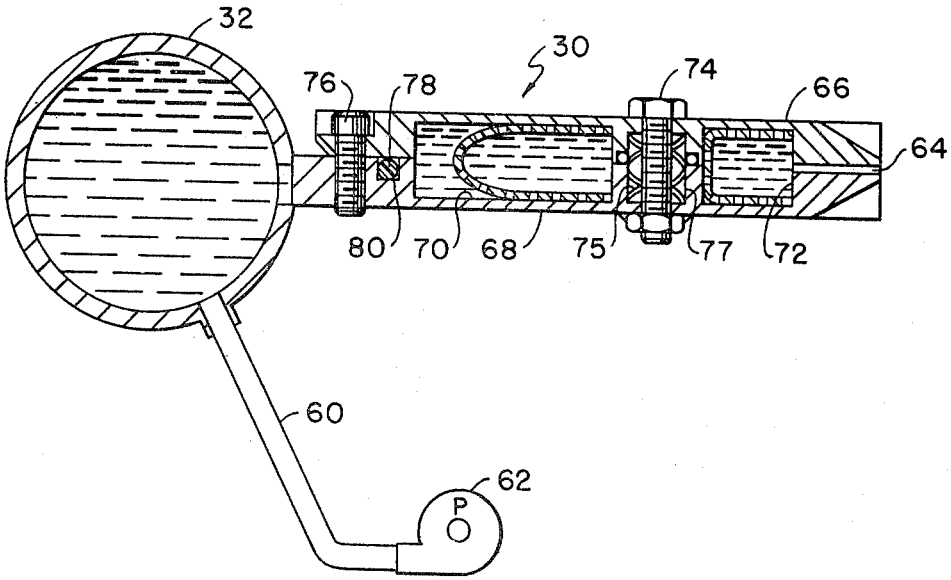
FIG. 4 is a section view taken on line 4—4 of FIG. 3.
Figure 5:
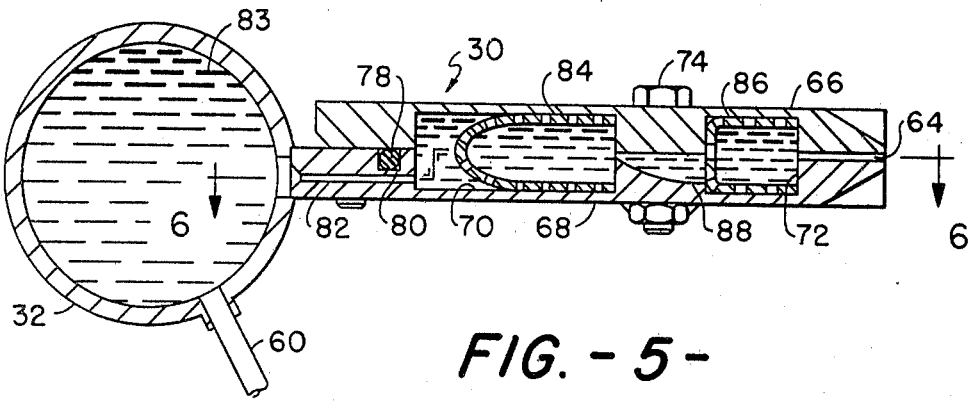
FIG. 5 is a section view taken on line 5—5 of FIG. 3.
Figure 6:
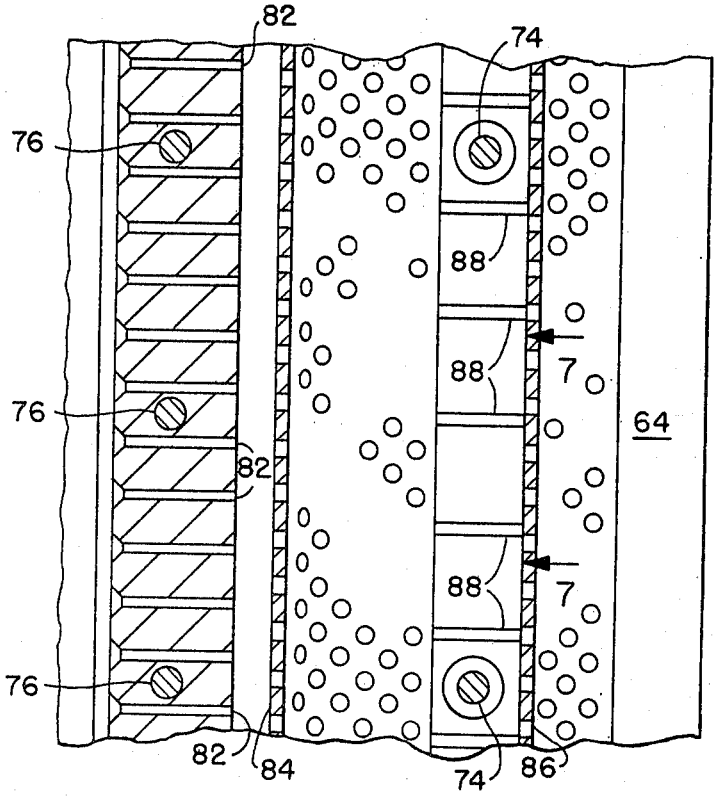
FIG. 6 is a section view taken on line 6—6 of FIG. 5.
Figure 7:
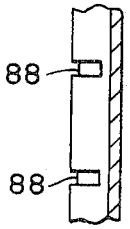
FIG. 7 is a view taken on line 7—7 of FIG. 6.

To produce the fabric 10 shown in FIG. 2, the system of FIG. 1 is employed wherein the tufted substrate 19 of acrylic, polyester, nylon, etc., fibers tufted into a backing material of jute, polypropylene or other suitable material is supplied from a supply roll 20 by a pair of driven feed rolls 22 and 24. The substrate 19 is supplied through the tension control apparatus 26, consisting of a plurality of tension bars and spreader rolls, to the water paste applicator roll 28. The extruder 30, supplied from a manifold 32, supplies a water paste solution of approximately 98% water and 2% thickeners to the rotating roll 28 which in turn applies the solution to the back side of the tufted fabric 19. The thickener is preferably carboxy methyl cellulose to provide a water paste solution with a viscosity of approximately 20,000 centipoise. The fabric 19 is guided by roll 34 onto the chill roll or freezing drum 36 whereat the solution is frozen to form the layer 16 prior to rotation into contact with the rotary cutters 40 and 42 in the cutting zone. The chill roll or freezing drum 36 is maintained at a temperature of approximately −30° F. to accomplish the desired freezing.

After the layer 16 is frozen, the fabric 19 with the frozen substrate thereon is rotated past the cutting rotors 40 and 42 whereat the loops of the loop pile, tufted fabrics are cut to form the pile fibers 12. The cutters 40 and 42 can be of any suitable type such as that shown and disclosed in U.S. Pat. No. 4,117,577. From the cutters 40 and 42 the cut pile fabric is delivered to the back coating application roll 45 over idler roll 44. The application roll 45 is supplied a back coating solution of latex, PVC, etc., by an extruder 46 supplied by a manifold 48. The application roll 45 supplies the desired back coating layer 18 adjacent the frozen layer 16 to form the fabric 10 shown in FIG. 2. From the applicator roll 45 the fabric 10 is supplied over a plurality of guide rolls 50 and up into a heating chamber 52. In the heating chamber 52 the fabric 10 is guided over a plurality of hot cans 54 by the rolls 56 to melt the frozen layer 16 and cure the back coating layer 18 to the cut pile tufted fabric. From the heating chamber, the fabric is taken up by a take-up roll 58.

In FIGS. 3–7 the preferred manifold 30 and extruder 32 for the water paste solution is shown in detail. The manifold 30 is supplied water paste solution via conduit 60 from a metering pump 62 which is connected to a water paste solution tank (not shown). The extruder 32 is an elongated member the width of which is selected to accommodate the width of fabric being coated and has an extrusion slot 64 of a height less than the thickness of the layer 16 to be applied to the fabric 19.

The extruder 32 consists basically of an upper body portion 66 and a lower body portion 68 with cavities therein which mate together to form the chambers 70 and 72. The body portions 66 and 68 are held together by suitable means such as a plurality of screws 74 and 76. The screws 74 retain the Beville springs 75 in the cavity 77 so that by loosening the screws 74, the opening of the extrusion slot 64 can be adjusted. The manifold is isolated from the chamber 70 by a sealing member 78 of neoprene or other suitable material located in notch 80 in the lower body portion 68. A plurality of orifices 82 are drilled in the lower body portion to provide communication for the water paste solution 83 from the manifold 32 to the chamber 70. Located within the chambers 70 and 72 are screens 84 and 86 to screen undesirable particles from the water paste solution 83 being delivered thereto. To supply solution 83 from the chamber 70 to the chamber 72 a plurality of knife shaped orifices 88 are provided in top of the lower body portion 68. These orifices will tend to even the flow of solution to the chamber 72.

It is obvious that a system has been described which will allow the application of an inexpensive backing to a web of material so that the web of material can be handled during a subsequent operation. Further, such backing for the web of material can be applied without harmful effect on the composition of the web of material and can be readily removed without a deleterious effect on the desired product. The provisions of the water paste solution extruder allows ease of application of a substrate which can be readily hardened to provide rigidity to the material being processed and which eliminates the use of excessive backing material such as latex, PVC, etc., normally employed for such purpose.

Although the preferred embodiment of the invention has been described, it is contemplated that many changes may be made without departing from the scope or spirit of the invention and I desire to be limited only by the claims.

We claim:

1. An extruder for a liquid comprising: an elongated body member having an inlet side and an outlet side, said body member having an upper portion and a lower portion connected together to form said body member, means forming a first chamber and a second chamber in said body member, a plurality of openings in said inlet side of said body member and in communication with said first chamber, a wall member separating said first chamber and said second chamber, a plurality of openings in said wall member between said first chamber and said second member and a slot in said outlet side of said body member in communication with said second chamber, each of said plurality of openings being knife shaped to even out the flow of liquid from the first chamber to the second chamber.

2. The extruder of claim 1 wherein a screen is located in said first chamber between said openings in said inlet side and said wall member.

3. The extruder of claim 2 wherein a second screen is located in said second chamber between said wall member and said slot.

4. An extruder for a liquid comprising: an elongated body member having an inlet side and an outlet side, said body member having an upper portion and a lower portion connected together to form said body member, means forming a first chamber and a second chamber in said body member, a plurality of openings in said inlet side of said body member and in communication with said first chamber, a wall member separating said first chamber and said second chamber, a plurality of openings in said wall member between said first chamber and said second member and a slot in said outlet side of said body member in communication with said second chamber, said extruder having a plurality of springs compressed between said upper portion and said lower portion to allow said slot to be adjusted.

5. The extruder of claim 4 wherein each of said plurality of openings is knife shaped to even out the flow of liquid from the first chamber to the second chamber.

6. The extruder of claim 5 wherein a screen is located in said first chamber between said openings in said inlet side and said wall member.

7. The extruder of claim 6 wherein a second screen is located in said second chamber between said wall member and said slot.

8. The extruder of claim 4 wherein a screen is located in said first chamber between said openings in said inlet side and said wall member.

9. The extruder of claim 8 wherein a second screen is located in said second chamber between said wall member and said slot.

* * * * *